United States Patent [19]

Reece et al.

[11] Patent Number: 4,947,564

[45] Date of Patent: Aug. 14, 1990

[54] INFORMATIONAL TRACKING CALENDAR

[76] Inventors: James S. Reece; Jonathan T. Reece, both of 420 N. Harding, Wichita, Kans. 67208

[21] Appl. No.: 354,807

[22] Filed: May 22, 1989

[51] Int. Cl.[5] ..... G09D 3/00

[52] U.S. Cl. ..... 40/110; 40/119

[58] Field of Search ..... 40/110, 119, 120; 283/2, 3, 4

[56] References Cited

U.S. PATENT DOCUMENTS

| | | | |
|---|---|---|---|
| 2,224,414 | 12/1940 | Spinner | 40/119 |
| 2,831,279 | 4/1958 | Esslinger, Jr. | 40/119 |
| 2,877,581 | 3/1959 | Woofter | 40/119 |
| 3,370,367 | 2/1968 | Stratton et al. | 40/119 |
| 4,028,826 | 6/1977 | Brandifino et al. | 40/110 |

*Primary Examiner*—Laurie K. Cranmer

*Attorney, Agent, or Firm*—Edward L. Brown, Jr.; William J. Miller

[57] ABSTRACT

A calendar for orienting selected sheets upon the happening of an event of program, is made from three portions: (a) a lower portion which contains a plurality of sheets where each sheet represents a selected period of time such as a mouth (b) an upper portion which contains a plurality of sheets containing printed and/or pictured information on both sides of the sheet and (c) a center portion which interconnects the upper portion and the lower portion using a ring or spiral binding system. Upon the happening of a selected event, such as conception, the particular mouth when conception occurs can be selected and the preceding sheets can be folded against the center portion, then the particular upper sheet containing the information relating to conception can be selected and along with the following remaining sheets of the upper section can be folded against the preselected unneeded sheets from the lower portion of the calendar. In the above manner, the particular data sheet consisting of information relating to conception and the events of the first month of pregnancy as well as the data sheets relating to the following months of pregnancy are completely available for reference by the interested person.

9 Claims, 1 Drawing Sheet

FIG 2
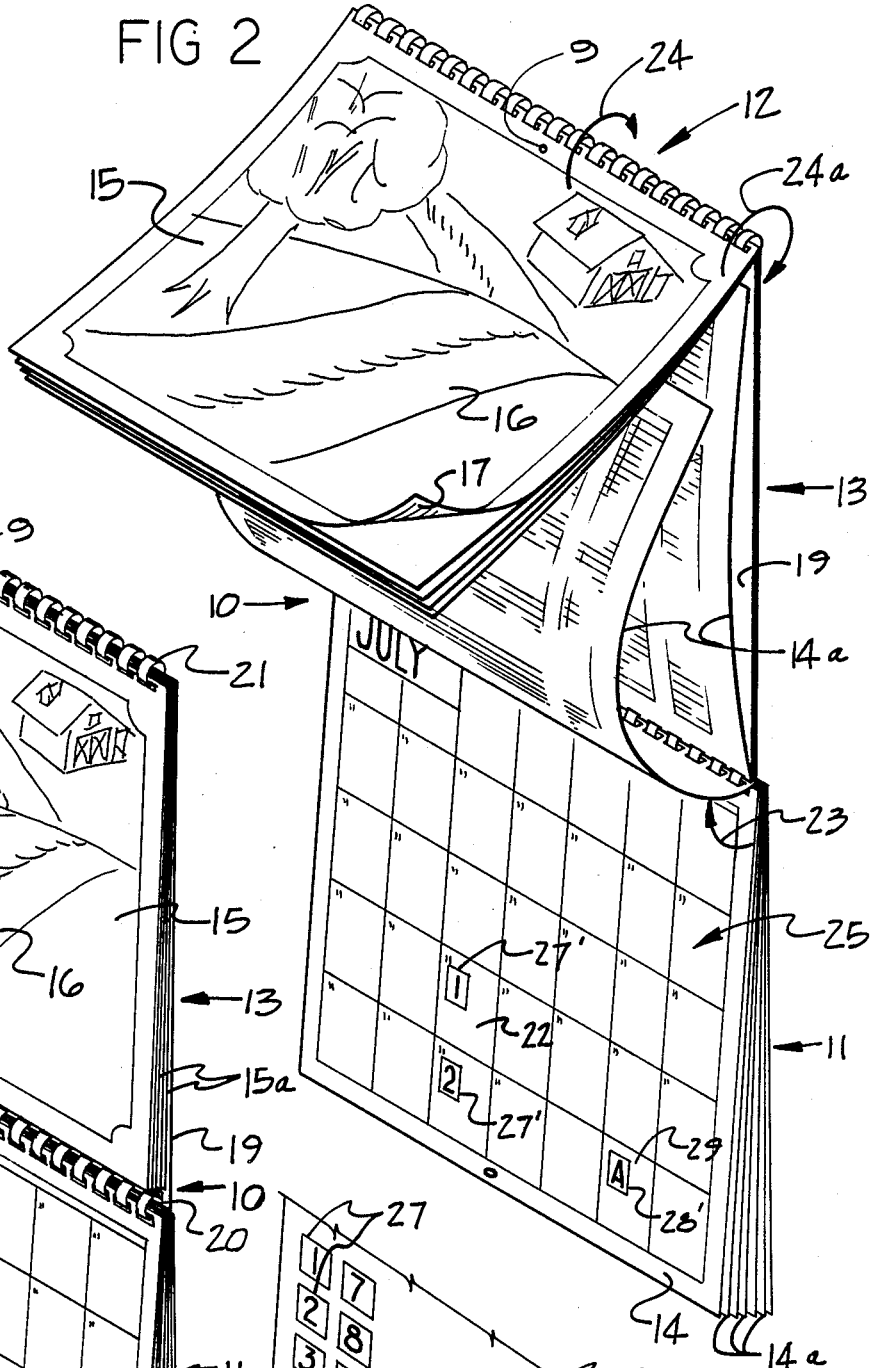
FIG 1
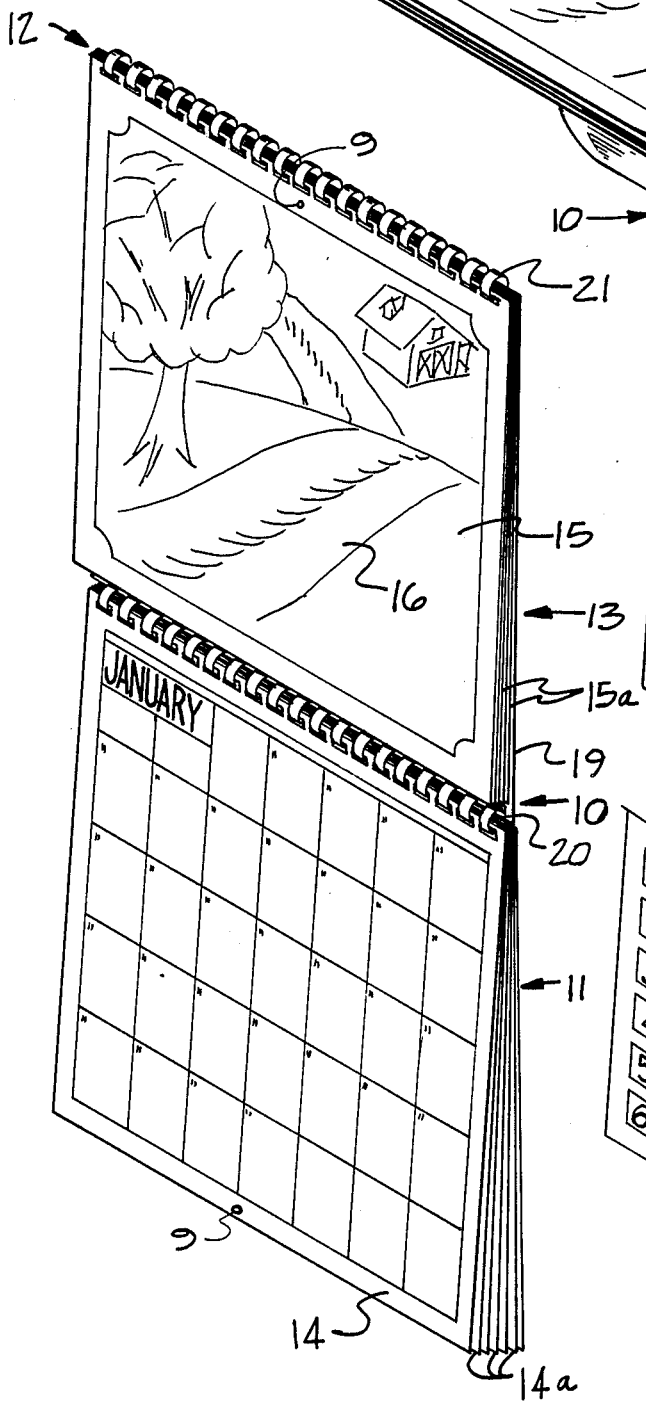
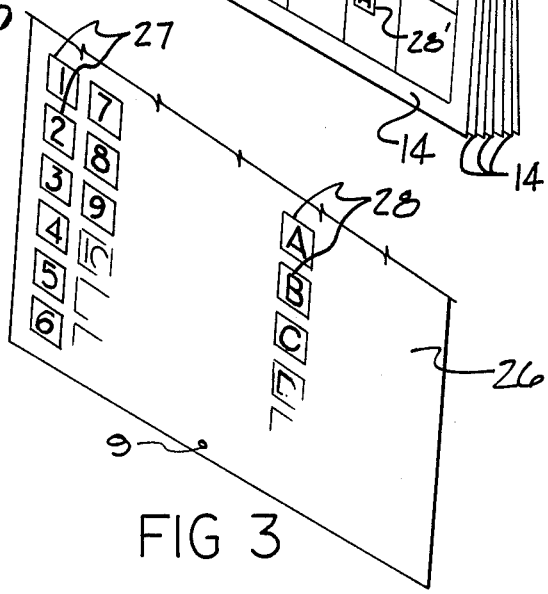
FIG 3

INFORMATIONAL TRACKING CALENDAR

BRIEF DESCRIPTION OF THE PRIOR ART

The best patents known to Applicant relating to calendar devices are patent Nos. 1,368,905 issued to G. H. Deaton and 2,831,279, issued to J. Esslinger, Jr.

The patent to Deaton comprises a lower portion wherein data is recorded during the month, such as the marking of memorandum, and when out of date, the cover sheet is swung up to a substantially horizontal position and the out of date record calendar sheet for the month, for example of September, is swung upwardly against the backing sheet and the cover sheet is then swung downwardly over the same. This invention then basically describes a way of storing used sheets and exposing a new sheet for the writing of data at a subsequent period of time.

The patent to Esslinger, Jr. illustrates a pivotal single upper sheet which is attached to the back of the tablet with sheets for the various months bound along the side. As each month is completed, the sheet is swung around to the back of the calendar by swinging the upper sheet free, moving the calendar sheet around to the back to expose a new calendar sheet and then the upper sheet is again laid flat against the new calendar sheet providing a picture or other information covering up the data or information that may be contained in the portion of the calendar above the monthly date information.

In neither of the calendars is there any way of organizing one portion, for example an upper portion, so that it can be related to the lower portion of the calendar.

BRIEF DESCRIPTION OF THE INVENTION

This invention describes an unique calendar which contains as many as a twenty-four month portion in the lower portion of the calendar and an upper portion of the calendar which contains a series of pages or sheets which are in sequence with the progression of an event, such as pregnancy or a physical fitness program. The calendar provides an unique method of interleaving the date of the occurrence of the event, for example the 10th of July, with the beginning of the data relating to the event, for example the first day of pregnancy or the date of conception or the date of the beginning of a physical fitness program.

The above is accomplished in an unique calendar which has a lower portion which contains, for example, twenty-four months, each month on a separate sheet or page, and a data portion which contains the data relating to the particular events, such as pregnancy, and the things that will occur during that month of pregnancy. At conception, for example, if the event began during July, then the months from January through and including June are flipped upwardly on a ring or spiral binding to a center portion of the calendar. The upper portion of the calendar which contains the data sheets is then lowered over the center portion of the calendar and on top of the previous months. The data sheets will hold the previous months in the center portion of the calendar and expose the first sheet relating to the first month of pregnancy. The facing sheet of the data sheet may contain a picture and the underside of the data sheet may contain all of the pertinent and necessary information relating to the changes in the body, the changes in the fetus and all other interesting information which a mother would need to know.

The last page of the calendar may contain a plurality of stickers. Such stickers, for example, would be numbered to represent segments of the event or program for the purpose of tracking said event or program. In the example of pregnancy, stickers numbered from one through forty-two would represent each week of the nine months of pregnancy and for a period of time after pregnancy. A second set of stickers can also be placed on the last sheet, which will represent certain selected important events which the user may wish to record, for example, first movement of the baby etc. These stickers can be pulled off and placed on the calendar when they occur or when they are expected to occur as a permanent record for the user.

BRIEF DESCRIPTION OF THE FIGURES

FIG. 1 illustrates a calendar showing the upper, lower and center portions of the calendar;

FIG. 2 shows a calendar in position after the sheets have been interleaved; and, FIG. 3 illustrates the last page of the calendar shown in FIGS. 1 and 2, having the plurality of stickers thereupon which can be positioned by the user upon the occurrence of selected events.

DETAILED DESCRIPTION OF THE FIGURES

Referring to all of the FIGURES, but in particular to FIGS. 1 and 2, a calendar generally referred by arrow 10, has a lower portion referred to by arrow 11, an upper portion referred to by arrow 12 and a center portion referred to by arrow 13. Lower portion 11 contains a plurality of individual sheets 14 which may contain as many as twenty-four. Sheets 14 are monthly calendars which, for example, may be labeled with each succeeding month, each having the days of the month printed thereon, for two successive years, for example 1989 and 1990, as is the usual for calendar pages. Upper portion 12 comprises a plurality of sheets 15 and **15*a*. Upper sheets 15 and 15*a* may contain a picture 16 appropriate to the time period of the event selected. The underside 17 of sheet 15 (see FIG. 2) may contain data which can be periodically referred by the mother or other interested party relating to the particular month of the event during the course of the event selected. Upper portion 12, in addition to sheet 15, contains a plurality of sheets 15*a*, while lower portion 11 contains sheet 14 and also contains a plurality of subsequent monthly sheets 14*a*. Sheets 14 and 14*a* are connected to center portion 13 which includes a cardboard backing 19, by a ring or spiral binder 20. Ring or spiral binder 20 could also be a well known spiral, plastic or metal binder, if desired. A second binder 21 connects sheets 15 and 15*a*, for example, in upper portion 12, to cardboard backing 19 of center portion 13. Each of the sheets contain a hole 9** for retaining the sheets in the upper position and for mounting the calendar.

OPERATION

Referring to FIGS. 1 and 2, but in particular to FIG. 2, calendar 10 consists essentially of three different parts as previously described, a lower portion 11, a center portion 13 and an upper portion 12. In order to use calendar 10, an event that is to be followed has to occur, for example conception initiating pregnancy. If, for example, pregnancy occurs at a certain day 22 of the month of July, then the sheets January through June which would represent sheets 14*a*, are flipped up in the direction of arrow 23 to center portion 13 of calendar 10. Then the first sheet 15 covering the first month relating to pregnancy and sheets 15*a* are moved upward as illustrated in FIG. 2 in the direction of arrow 24 with sheets 14 tucked under sheets 15 and 15*a*. Sheets 15 and 15*a* are then lowered against sheets 14*a* exposing sheet 15 and the month of July on sheet 14. Face sheet 15 may have a picture 16 relating to the first month of pregnancy or other event. Underneath face sheet 15 is the underside 17 which has data relating to all of the things that are occurring to the mother and the baby during the first month of pregnancy. When the end of July occurs, then sheet 25, illustrated in FIG. 2, is then flipped up in the direction of arrow 23 and the same sheet 15 is then continued in this example, for the next two weeks until a full month has expired for sheet 15. The first month sheet 15 is flipped over to the back of cardboard 19 in the direction of arrow 24*a*. A new picture 16 relating to the second month of pregnancy is now exposed along with the data on underside 17 relating to the things that are occurring to the mother and the baby during the second method of pregnancy.

Referring to FIG. 3, last sheet 26 has a plurality of tabs 27 numbered "1", "2", et seq. which relate to each week of pregnancy, and tabs 28 labeled "A", "B", "C", et seq. which relate to events which will occur during pregnancy for the normal nine month period. At the time of conception, as can be best determined, tab 27 representing the first week "1" will be removed from sheet 26 and transferred to date of July as 27′. Then the balance of the remaining tabs 27 are removed and added to the calendar face each new week following week "1" until all of the tabs have been placed in the various sheets 14 of calendar 10. If, for example, a special event occurs on day 29, then tab 28 labeled "A" will be transferred to day 29 in FIG. 2 and inserted as illustrated as 29′. As each month progresses, tabs 28 "A", "B", "C", et seq. are placed on the particular days they occur as a reminder of the event. Calendars of other topics could use similar tabs arranged to track a given specific topic.

CONCLUSIONS

An unique calendar has been disclosed which provides for record keeping for an event such as pregnancy or physical fitness, nutrition or any other subject that has events that are benefited by keeping track of progress where each day and each week can be completely oriented regardless of when, during the year, the event occurred. Twenty-four months are provided to cover an event such as conception or other event during the end of the year, then the period of time remaining will need to be included in the new year to follow through a nine to twelve month period. For the above reasons, a new calendar would not need to be purchased and a total record of the pregnancy or other event could be included in a single calendar as a memorabilia for the mother and child.

In the particular embodiment disclosed, ring or spiral binders were shown along the bottom and top edge of center portion 13, it is also obvious that upper portion could be attached by binding along either side of center portion 13 and still be well within the spirit and scope of this invention.

It is obvious, of course, that other modifications can be made and still be well within the spirit and scope of this invention as described in the specification and appended claims.

What I claim is:

1. A calendar for orienting selected sheets upon the happening of an event comprising:

(a) a lower portion comprising a plurality of sheets wherein each sheet represents a selected period of time;

(b) an upper portion comprising a plurality of sheets containing printed information thereupon said sheets having a length and width;

(c) a center portion having a length and width substantially the same as one of said plurality of sheets;

(d) loose-leaf means for binding said plurality of sheets in said upper portion to said center portion so that said plurality of sheets extend over said center portion and said plurality of sheets maintain a selected sequence; and, (e) loose-leaf means for binding said plurality of sheets in said lower portion to said center portion, whereby a selected sheet of said lower portion can be exposed by positioning said preceding sheets of said lower portion to said center portion and wherein a selected sheet from said upper portion can be positioned on top of said preceding sheets from said lower portion on said center section.

2. A calendar as claimed in claim 1 wherein said plurality of sheets in said lower section comprise a monthly calendar in sequential order.

3. A calendar as claimed in claim 2 wherein said plurality of upper sheets contain sequential monthly data relating to the period of time from conception until delivery of a human baby.

4. A calendar as claimed in claim 2 wherein one of said sheets of said upper or lower portions contains a plurality of removable tabs having printed events thereon and means for removing a selected tab or tabs and affixing one of said plurality of said tabs on a sheet on said lower portion containing the date of the occurrence of said event.

5. A calendar as claimed in claim 2 wherein said plurality of sheets comprise between twelve to twenty-four months arranged in sequence.

6. A calendar as claimed in claim 1 wherein said plurality of upper sheets contain sequential data relating to a period of time such as from conception until delivery of a human baby.

7. A calendar as claimed in claim 1 wherein said center portion has an upper edge and a lower edge and wherein said upper and lower portions are bound to said center portion along said upper and lower edges, respectively.

8. A calendar as claimed in claim 7 wherein said upper and center portions are configured in a manner to allow said upper and center portions to fold against said lower portion for providing a compact transportable calendar.

9. A calendar as claimed in claim 1 wherein said exposed side of said selected sheet from said upper portion contains a picture and wherein the unexposed side of said sheet contains data relating to the said event.

* * * * *